United States Patent [19]

Eckstein et al.

[11] 4,448,157

[45] May 15, 1984

[54] AUXILIARY POWER UNIT FOR VEHICLES

[76] Inventors: Robert J. Eckstein, 1202 Fairfield Rd., Round Lake Beach, Ill. 60073; Roger L. Mason, 3156 Fulling Mill Rd., Middletown, Pa. 17057

[21] Appl. No.: 355,770

[22] Filed: Mar. 8, 1982

[51] Int. Cl.[3] ..... F02N 17/02

[52] U.S. Cl. ..... 123/142.5 R; 123/179 E

[58] Field of Search ..... 123/142.5 R, 179 D, 123/179 E

[56] References Cited

U.S. PATENT DOCUMENTS

| | | | |
|---|---|---|---|
| 1,974,907 | 9/1934 | Worth | 123/142.5 R |
| 1,992,568 | 2/1935 | Connor | 123/142.5 R |
| 2,070,615 | 2/1937 | Plante | 123/142.5 R |

*Primary Examiner*—Ira S. Lazarus

*Attorney, Agent, or Firm*—Bernard L. Kleinke

[57] ABSTRACT

The auxiliary power unit includes an auxiliary liquid-cooled diesel internal combustion engine for driving power producing equipment on board the vehicle. A first conduit connects the main engine liquid coolant outlet in fluid communication with the auxiliary engine liquid inlet. A second conduit connects the main vehicle engine liquid inlet in fluid communication with the auxiliary engine outlet. A pump recirculates the liquid coolant through the conduits so that the auxiliary diesel engine heats the coolant and thus the main engine, when it is not in use. The engine is controlled remotely from the vehicle cab.

10 Claims, 3 Drawing Figures

AUXILIARY POWER UNIT FOR VEHICLES

DESCRIPTION

1. Technical Field

The present invention relates in general to an auxiliary power unit, and it more particularly relates to an auxiliary power unit used on vehicles, such as trucks, for powering electrical equipment thereon, and other devices used on vehicles.

2. Background Art

Where the weather is extremely cold, oftentimes it is necessary to leave the large diesel engine of a truck running in its idle condition for the entire night, to prevent the problem of hard starting of the engine in the morning. By idling the engine overnight, the parts of the engine remain warm to avoid undue wear resulting from cold starting conditions. However, by permitting the engine to idle for long periods of time, the engine parts, such as piston rings, rods and the like, experience undue and excessive wear. Also, "wet stacking" occurs due to piston ring leakage as a result of the idling of the diesel engine for long periods of time.

In an attempt to overcome these problems, there have been provided gasoline engine-driven auxiliary alternators which are carried on board the diesel-powered vehicle to supply auxiliary electrical energy for the electrical equipment on board the vehicle, when it is parked overnight. In this regard, the auxiliary power unit can be used to power electric blankets and appliances, such as television sets, used by the driver who, oftentimes, chooses to sleep in the cab of the vehicle. Also, in the morning, should hard starting occur for the diesel vehicle engine, the gasoline powered auxiliary unit is used to supply additional electrical energy to help start the large diesel engine.

However, the gasoline powered auxiliary power unit is not entirely satisfactory for some applications, since the problem still exists of undue and excessive wear caused by the cold starting of the diesel engine during cold winter months. Also, the operation of the gasoline powered auxiliary unit is quite expensive at the present time due to the high price of gasoline. Moreover, the auxiliary power unit carries its own gasoline tank, which adds extra weight to the vehicle, thereby causing space problems, as well as excessive and unwanted fuel consumption of the vehicle engine.

Therefore, it would be highly desirable to have an auxiliary power unit for vehicles to enable electrical equipment to be powered during the evening when the vehicle engine is not in use, and at the same time, enable the vehicle diesel engine to remain warm during the cold overnight conditions, without requiring the diesel engine to idle. Also, such an auxiliary power unit should not be excessively heavy in weight, and should be small and compact in size.

DISCLOSURE OF INVENTION

Therefore, the principal object of the present invention is to provide a new and improved vehicle auxiliary power unit, which can energize electrical equipment and other such power utilizing equipment for vehicles, and which enables a diesel engine for the vehicle to remain warm when the engine is not operating, even during excessively cold ambient temperatures.

Another object of the present invention is to provide such a new and improved auxiliary power unit, which is light in weight, and which is very compact in size.

Briefly, the above and further objects of the present invention are realized by providing a diesel-powered auxiliary power unit. The auxiliary power unit includes an auxiliary liquid-cooled diesel internal combustion engine for driving power producing equipment on board the vehicle. A first conduit connects the main engine liquid coolant outlet in fluid communication with the auxiliary engine liquid inlet. A second conduit connects the main vehicle engine liquid inlet in fluid communication with the auxiliary engine outlet. A pump recirculates the liquid coolant through the conduits so that the auxiliary diesel engine heats the coolant and thus the main engine, when it is not in use. The engine is controlled remotely from the vehicle cab.

Thus, when the main engine is not operating, the auxiliary power unit is used to energize the vehicle onboard equipment, and the main engine coolant is heated to keep it warm to facilitate fast starting of the main engine in cold ambient temperature conditions. Also, there is no need for an additional heavy, bulky fuel tank, since the auxiliary diesel engine is powered by the same diesel fuel, which is used for the main engine, and which is relatively inexpensive.

Since the auxiliary engine is controlled remotely from the cab of the vehicle, the auxiliary power unit may be positioned at different locations on the vehicle, where desired.

BRIEF DESCRIPTION OF DRAWINGS

The above-mentioned and other objects and features of this invention and the manner of attaining them will become apparent, and the invention itself will be best understood by reference to the following description of an embodiment of the invention taken in conjunction with the accompanying drawings, wherein.

BEST MODE FOR CARRYING OUT THE INVENTION

Figure 1:
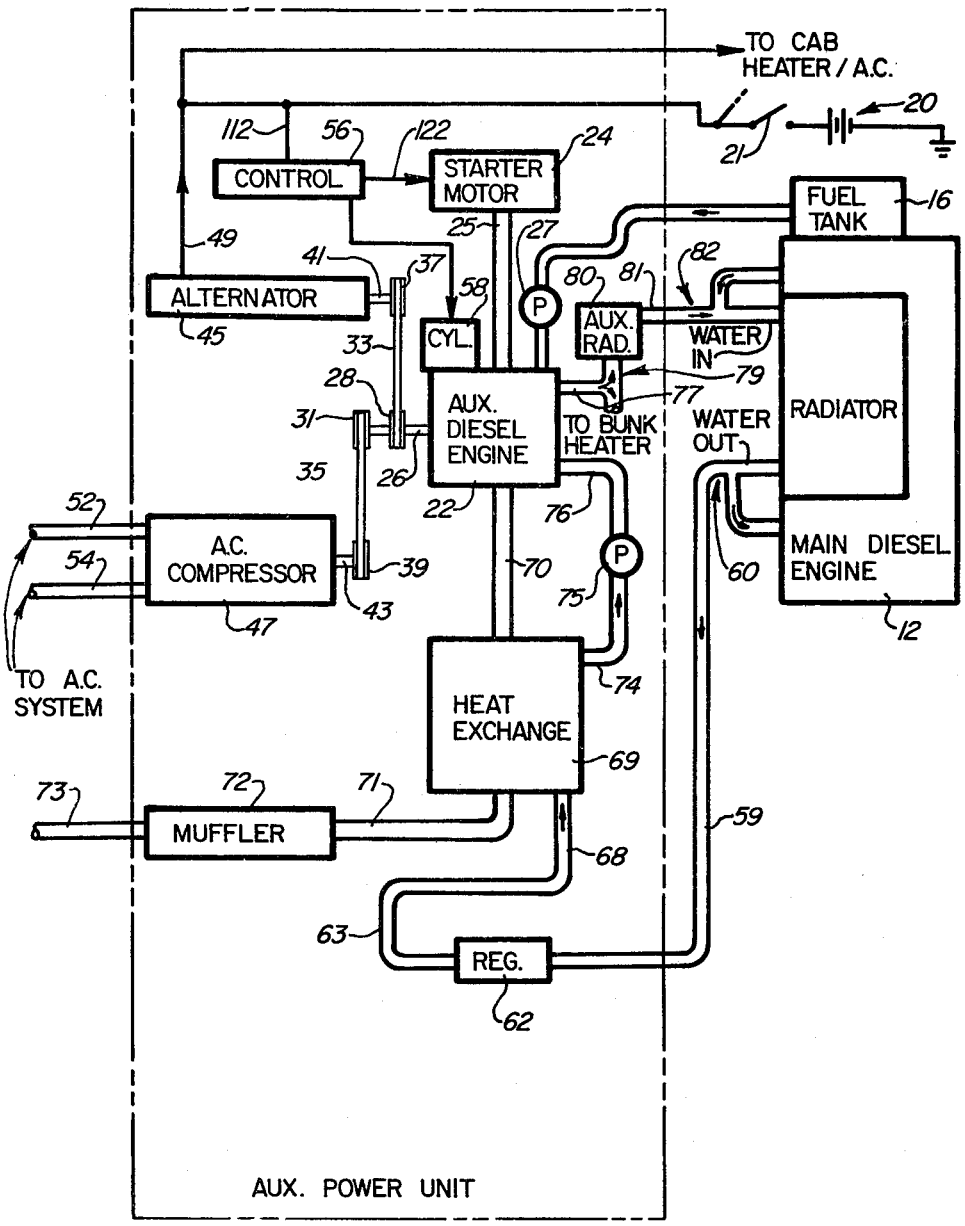
FIG. 1 is a diagrammatic view of the auxiliary power unit, which is constructed in accordance with the present invention.

Referring now to the drawings, and more particularly to FIG. 1 thereof, there is shown an on-board auxiliary power unit 10, which is constructed in accordance with the present invention, and which is adapted to be used with a main diesel engine 12 of a vehicle (not shown), such as a tractor-trailer truck. The vehicle includes a fuel tank 16 for the main diesel engine 12, a radiator 18 for the main diesel engine 12, and a battery 20, which supplies electrical energy to the vehicle when the switch 21 is closed.

Considering now the power unit 10 in greater detail, the power unit 10 includes an auxiliary diesel engine 22, which is a water cooled engine. The diesel engine 22 is started by means of a starter motor 24 having a drive shaft 25 connected drivingly to the diesel engine 22. An auxiliary fuel pump 27 conveys diesel fuel to the auxiliary engine 22 from the vehicle tank 16. Thus, no separate fuel tank is required for the engine 22.

The engine 22 has an output shaft 26 having a pair of output pulleys 28 and 31 fixed thereto. A pair of chains 33 and 35 connect drivingly the respective output pulleys 28 and 31 to a pair of input pulleys 37 and 39, respectively, mounted on a pair of respective input shafts 41 and 43 of an alternator 45 and an air conditioning compressor 47, respectively.

An electrical output lead 49 from the alternator 45 supplies electrical energy to devices (not shown) disposed in the vehicle cab (not shown), such devices including the vehicle cab heater (not shown) and the vehicle cab air conditioning unit (not shown). The output lead 49 is also connected to the switch 21 to charge the battery 20, when the switch 21 is closed. A pair of refrigerant lines 52 and 54 from the air conditioning compressor 47 supply refrigerant to and from the other components (not shown) of the air conditioning unit.

A control panel 56 is mounted in the vehicle cab and is used to control the auxiliary power unit 10 remotely, as hereinafter described in greater detail.

In order to maintain the water used for cooling the main diesel engine 12 at an elevated temperature to facilitate starting of the vehicle, the water is recirculated through the auxiliary diesel engine 22 and the radiator 18 for the main diesel engine 12. For this purpose, a conduit 59 is connected to a T-connector 60 at the water outlet for the radiator 18. A temperature regulator 62 connects the other end of the conduit 59 to a conduit 63, which is connected at its opposite end to an inlet 68 of a heat exchanger 69. The regulator 62 serves to protect the power unit 10, in that should the temperature of the coolant exceed a predetermined value, the engine 22 is shut down in accordance with conventional techniques.

A muffler pipe 70 from the auxiliary engine 22 is connected in fluid communication with the heat exchanger 69, and a pipe 71 interconnects the outlet of the heat exchanger 69 with a muffler 72, which has an exhaust pipe 73 vented to the atmosphere. In this manner, heat is transferred from the exhaust gas from the engine 22 to the coolant water flowing through the heat exchanger 69.

In order to convey the heated coolant water from the heat exchanger 69, the heated coolant water flows from a heat exchanger outlet 74 to an auxiliary water pump 75, which discharges the heated water into an engine coolant inlet 76. The coolant flows from an engine coolant outlet to a T-connector 79 which supplies the heated liquid to the bunk heater in the cab and to an auxiliary radiator 80, which cools the heated coolant to a desired condition. In this regard, the auxiliary radiator 80 provides a control for the heated coolant, in the event that the large engine radiator 18 is unable to maintain the coolant at a desired temperature. During the operation of the auxiliary power unit 10, the engine 12 is not operated, and therefore the vehicle engine fan (not shown) is not operative, and therefore cooling occurs at the large radiator 18 by convection and conduction therefrom without the aid of the engine fan.

A conduit 81 conveys the cooled water from the auxiliary radiator 80 through a T-connector 82 to the water inlet for the large radiator 18. Thus, the path of recirculation is complete. Therefore, heated water is continuously recirculated through the main engine to maintain it at a temperature above the ambient temperature conditions, thereby greatly improving the starting of the main engine after long periods of time, without the necessity of idling the main engine.

Figure 2:
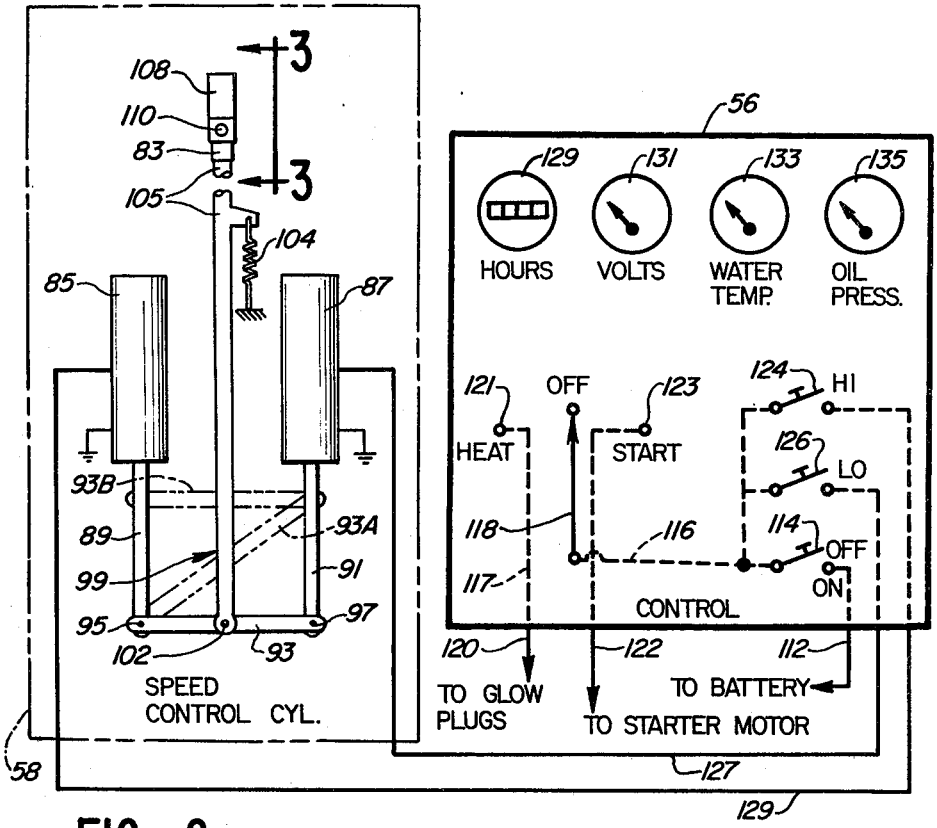
FIG. 2 is a partially diagrammatic view of the speed control unit and the control panel of the auxiliary power unit of FIG. 1.
Figure 3:
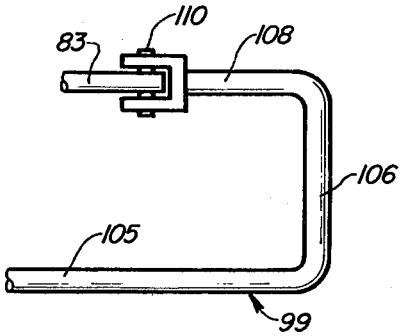
FIG. 3 is an elevational cross-sectional view of a portion of the linkage for the speed control taken substantially on line 3—3 of FIG. 2.

Considering now the speed control cylinders 58 in greater detail with particular reference to FIG. 2 of the drawings, the speed control cylinders 58 are used to move a throttle 83 (shown fragmentarily in FIGS. 2 and 3 of the drawings), which thereby governs the speed of the auxiliary diesel engine 22. In this regard, the throttle 83 is moved rearwardly through different discrete speed-adjusting positions to set the speed of the engine during start-up and shut-down operations. A high-speed piston cylinder assembly 85 and a low-speed piston cylinder assembly 87 are mounted in a parallel, spaced-apart, side-by-side manner on the engine 22 and have a pair of respective piston rods 89 and 91 adapted to move in parallel spaced-apart paths of travel. As hereinafter described in greater detail, when the cylinder 87 is energized, the engine 22 is caused to idle at a low speed. When the cylinder 85 is energized, the engine 22 is caused to operate at a high speed.

A cross-link 93 is connected pivotally at its opposite ends at 95 and 97 to the respective ends of the piston rods 89 and 91. A J-shaped longitudinal linkage or rod 99 is pivotally connected at the point 102 of the cross-link 93 midway between its ends, and extends backwardly therefrom between the spaced-apart cylinder assemblies 85 and 87. A tension spring 104 is attached to the rod to resiliently urge it forwardly to the OFF position as indicated in solid lines.

Considering now the rod 99 in greater detail, the rod 99 includes a rearwardly extending portion 105, which is attached to one end of the spring 104. As best seen in FIG. 5, the rearwardly extending portion 105 terminates in an upwardly extending bent upright portion 106, which in turn is connected integrally to a forwardly extending distal portion 108. The portion 108 is, in turn, pivotally attached at 110 to the throttle 83.

Considering now the control panel 56 in greater detail with particular reference to FIG. 2, the control panel is mounted within the vehicle cab and is used to control and to monitor the engine 22. For example, the speed control cylinders are activated remotely from the panel 56.

The control panel has a battery lead 112, which is connected, at one of its ends, through the switch 21 to the vehicle battery 20 (FIG. 1), and at its opposite end (FIG. 2), to a manually operable ON-OFF switch 114 on the control panel 56. When the switch 114 is closed, the battery lead 112 is connected to a lead 116, which in turn is connected to a three-position manually operable start switch wiper 118 mounted on the control panel, normally disposed in its OFF position, as shown in the drawings. When it is desired to start the auxiliary engine, the wiper 118 is moved to the HEAT position to connect the lead 117 via the wiper 118 to a lead 120 for energizing the glow plugs (not shown) for the diesel engine 22. The wiper 118 is connected to a terminal 121 at the HEAT position to establish a connection from the battery 20 to the lead 112, the ON-OFF switch 114, the lead 116, the wiper 118, the terminal 121, the lead 117, and then to the lead 120, which extends to the glow plugs.

Once the glow plugs have been energized for a sufficiently long period of time, the wiper 118 is then switched to a terminal 123 to connect the lead 116 through the wiper 118 to a lead 122, which is connected to the starter motor 24 for energizing it. As a result, the starter motor then causes the engine 22 to start.

In order to control the setting of the engine speed at a low idle speed for the initial start up of the engine 22, a low speed manually-operable switch 124 mounted on the control panel is closed to connect the battery lead 112 through the ON-OFF switch 114 to a lead 127 extending to the low speed cylinder 87 for energizing it. When it energizes, it retracts its piston rod 91 to cause the link 93 to pivot about the pivot point 95 in a counterclockwise position until it assumes a diagonal position as indicated in broken lines at 93A in FIG. 2. In this position, the front end of the rod 99 moves rearwardly, thereby causing the throttle 83 to be pulled rearwardly for setting the low speed idle condition for the engine 22.

Thereafter, in order to set the engine 22 to a higher running speed, a high-speed, normally open, manually-operable switch 126 mounted on the control panel 56 is then closed to connect the battery lead 112 through the switches 114 and 126 to a lead 129, which in turn is connected to the high-speed cylinder assembly 85 for energizing it. In so doing, the piston rod 89 retracts to cause the cross-link 93 to pivot about its pivot point 97 into a transverse position substantially perpendicular to the rod 99, as indicated in phantom lines at 93B. In so doing, the mid-point 102 of the link 93 is moved rearwardly to a greater extent for causing the rod 99 to pull the throttle 83 rearwardly by a like amount. As a result, the speed of the engine 22 increases to its high speed setting. The engine 22 remains operating at its high speed, to drive the alternator 45 and the air conditioner compressor 47.

In order to stop the engine 22, the procedure is reversed.

On the face of the control panel 56, there is provided an hour gauge 129 for monitoring the number of hours of operation of the engine 22 so that the oil can be changed after a predetermined number of hours of operation thereof. A volt meter 131, a water temperature meter 133 and an oil pressure meter 135 are also provided for monitoring the function of the engine 22.

While a particular embodiment of the present invention has been disclosed, it is to be understood that various different modifications are possible and are contemplated within the true spirit and scope of the appended claims. For example, many different types and kinds of materials may be employed for the various components of the auxiliary power unit 10. There is no intention, therefore, of limitations to the exact abstract or disclosure herein presented.

We claim:

1. In an auxiliary power unit for operation with a vehicle main liquid-cooled diesel internal combustion engine having a liquid coolant inlet and a liquid coolant outlet, and having a radiator, and exhaust gas conduit and a vehicle diesel fuel tank, apparatus comprising:

a small auxiliary liquid-cooled diesel internal combustion engine having an output shaft, said engine having liquid inlet means and liquid outlet means;

power producing means having an input shaft drivingly connected to said output shaft for producing electrical energy;

a first T connector for connecting in fluid communication the main engine radiator and the coolant outlet of the main engine;

first conduit means connecting in fluid communication the first T connector and the auxiliary engine liquid inlet;

a second T connector for connecting in fluid communication the main engine radiator and the coolant inlet of the main engine;

second conduit means coupling in fluid communication the main engine liquid inlet means and the auxiliary engine outlet means to complete a single closed-loop coolant path of recirculation;

pumping means for recirculating coolant through said path of recirculation including said conduit means;

heat exchanging means connected in fluid communication in said coolant path of recirculation for supplying heat to said coolant being recirculated;

means connecting the main engine exhaust gas conduit to said heat exchanging means for supplying heat thereto to, in turn, supply said heat to the coolant flowing through said heat exchanging means; and means for conveying diesel fuel from the main engine fuel tank.

2. An apparatus according to claim 1, wherein the auxiliary engine includes throttle means for adjusting the speed of the auxiliary engine, further including speed control means connected to said throttle means for moving forcibly said throttle means through a plurality of discrete speed adjusting positions.

3. An apparatus according to claim 2, further including control panel means for actuating said speed control means remotely.

4. An apparatus according to claim 3, wherein said speed control means includes a high speed piston cylinder assembly and a low speed piston cylinder assembly for moving said throttle means to a high speed discrete position and a low speed discrete position, respectively.

5. An apparatus according to claim 2, wherein said piston cylinder assemblies each has a reciprocating piston rod, said pair of cylinder assemblies being disposed in a side-by-side relationship to enable their piston rods to move reciprocatively in a pair of parallel spaced-apart paths of travel, said speed control means including a cross-link pivotally connected at its ends to the respective ones of said piston rods, and a longitudinal linkage connected pivotally at its front end to the mid-point of said cross-link and at its rear end to said throttle means, said assemblies being activated independently.

6. An apparatus according to claim 5, wherein said control panel means includes first and second electrical switch means for causing said piston cylinder means to be energized electrically and selectively.

7. An apparatus according to claim 1, further includes an auxiliary radiator connected in fluid communication with the recirculating coolant.

8. An apparatus according to claim 7, further including a fuel pump for causing fuel to be transferred from the vehicle fuel tank to said auxiliary engine.

9. An apparatus according to claim 1, further including a fuel pump for causing fuel to be transferred from the vehicle fuel tank to said auxiliary engine.

10. An apparatus according to claim 1, including an air condition compressor driven by said engine for operating with a vehicle air conditioning system.

* * * * *